US007500919B2

(12) United States Patent
Priegel

(10) Patent No.: US 7,500,919 B2
(45) Date of Patent: Mar. 10, 2009

(54) MOUNTING DEVICE FOR FLAG POLE

(75) Inventor: Jack C. Priegel, El Paso, TX (US)

(73) Assignee: Wind Gear Direct, LLC, El Paso, TX (US)

( * ) Notice: Subject to any disclaimer, the term of this patent is extended or adjusted under 35 U.S.C. 154(b) by 0 days.

(21) Appl. No.: 11/622,639

(22) Filed: Jan. 12, 2007

(65) Prior Publication Data

US 2008/0171608 A1 Jul. 17, 2008

(51) Int. Cl.
*A63B 57/00* (2006.01)

(52) U.S. Cl. ..... 473/176

(58) Field of Classification Search ..... 273/173–179
See application file for complete search history.

(56) References Cited

U.S. PATENT DOCUMENTS

| | | | | |
|---|---|---|---|---|
| 0,979,313 | A | 12/1910 | King et al. | |
| 1,291,067 | A | 1/1919 | Michael | |
| 1,548,289 | A | 8/1925 | Sparks | |
| 1,568,320 | A | 1/1926 | Coldwell | |
| 1,599,734 | A | 9/1926 | Wilson | |
| 1,676,954 | A | 7/1928 | Kannemann | |
| 1,829,283 | A | 10/1931 | Kip | |
| 3,310,026 | A | 3/1967 | Baird, Jr. | |
| 3,348,797 | A | 10/1967 | Turbyfill | |
| 3,732,845 | A | 5/1973 | Istre | |
| 4,114,879 | A | 9/1978 | Oiler | |
| 4,360,200 | A * | 11/1982 | English | 473/177 |
| 4,928,417 | A | 5/1990 | Boudreau | |
| 5,249,384 | A | 10/1993 | Dark, Jr. | |
| 5,351,950 | A | 10/1994 | Frankum | |
| 5,393,053 | A * | 2/1995 | Wiese et al. | 473/177 |
| 5,451,045 | A * | 9/1995 | Garske | 473/176 |
| 6,113,503 | A | 9/2000 | Brookman | |
| 6,409,608 | B1 | 6/2002 | Garske | |
| 6,478,687 | B1 | 11/2002 | Colonello | |
| 6,722,997 | B2 | 4/2004 | Gilmour | |
| 6,726,170 | B2 | 4/2004 | Luo | |
| 6,939,239 | B1 | 9/2005 | Ash | |
| 7,033,279 | B2 | 4/2006 | Garske | |
| 7,033,280 | B2 | 4/2006 | Hottle et al. | |
| 2001/0027626 | A1 * | 10/2001 | Natelli, Jr. | 52/170 |
| 2002/0094878 | A1 | 7/2002 | Porter | |
| 2002/0198059 | A1 * | 12/2002 | Gilmour | 473/176 |
| 2006/0180729 | A1 * | 8/2006 | Yang | 248/508 |
| 2006/0189401 | A1 | 8/2006 | Garske | |

OTHER PUBLICATIONS

Reliable Golf Course Supplies, 2006 Golf Course Supply Catalog, p. 23.

* cited by examiner

*Primary Examiner*—Mark S Graham
(74) *Attorney, Agent, or Firm*—Fitch, Even, Tabin & Flannery

(57) ABSTRACT

A mounting device for the end of a flag pole that provides an enhanced coupling of the pole within a golf cup is provided. The mounting device includes a securement rib that fastens to the pole without adhesive or secondary fasteners. The mounting device also includes features to minimize sticking to the golf cup and provides for a more upright presentation of the flag pole even in windy or breezing conditions.

12 Claims, 7 Drawing Sheets

MOUNTING DEVICE FOR FLAG POLE

FIELD

The invention relates to a mounting device for a flag pole, and particularly, to a ferrule for mounting a golf flag pole in a golf cup.

BACKGROUND

In order to support a golf flag pole within a golf cup, the flag pole is typically attached to a metal ferrule, which is usually zinc or a zinc alloy, at a lower end of the flag pole. The metal ferrule facilitates insertion of the flag pole into a receiving hole positioned in the center of the golf cup. In this manner, the flag pole is positioned to display the pin flag and hole location to an approaching golfer.

The flag pole is often fabricated out of fiberglass or wood and must be secured to the metal ferrule, usually by insertion through a hollow cylindrical hole in the center of the ferrule. To insure attachment of the pole to the ferrule, adhesive is often employed to form a bond between the pole and ferrule. However, if the proper type or amount of adhesive is not used, or if curing conditions are not optimal, then the pin and ferrule may separate when golfers grasp and lift the flag stick out of the cup. On the other hand, attempting to employ an adhesiveless or friction-type fit between the fiberglass or wood pole and metal ferrule has also been unsatisfactory. Over time, the differences in surfaces between the fiberglass or wood and the metal ferrule combined with the repeated removal from the golf cup can result in a separation between the pole and ferrule, such as when the metal cuts into the fiberglass or wood and thereby decreases the tightness of the friction-type fit.

When the ferrule is received in the golf cup hole, there can be a tendency for the two components to stick together. When this occurs, golfers can pull a portion of or the entire golf cup out of the ground when they attempt to remove the pin. This problem is even more pronounced in a dessert or high humidity environment where sand or moisture can be trapped between the cup and ferrule to allow the ferrule and cup to stick together.

In an effort to reduce sticking between the ferrule and cup, various modifications to the ferrule have been employed. For instance, ribs have been provided along the sides of the ferrule body so as to reduce the contact area between the ferrule and cup. In addition, the side walls of the ferrule have been tapered inwardly to further minimize contact area and permit easier pole removal. However, these solutions have the shortcomings that the ribs often leave insufficient contact area to provide a stable coupling, and the tapered side walls may result in excessive leaning of the flag stick or render the flag susceptible to movement even in moderate breezes.

Accordingly, there is a desire for an attachment device for use between a flag pole and a golf cup that provides a secure connection yet allows ease of pole insertion and removal without disturbing the cup embedded within the ground.

DETAILED DESCRIPTION

Figure 1:
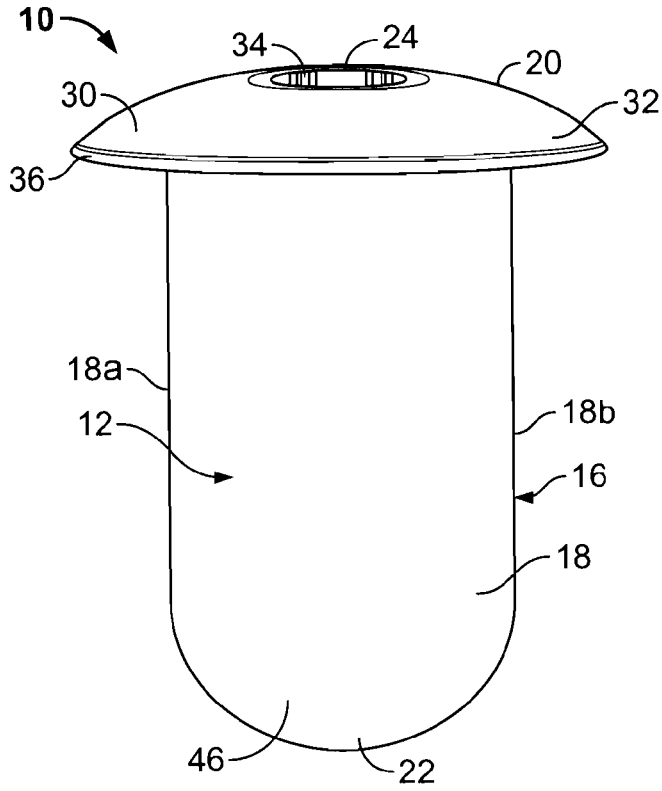
FIG. 1 is a elevational view of a first embodiment of a mounting device for a flag pole.

A first embodiment of a flag pole mounting device 10 is illustrated in FIGS. 1-6 in the form of a ferrule 12 that is securable to an end of a flag pole 14. The ferrule 12 includes a generally cylindrically body 16 having a side wall 18, a first end 20, and a second end 22. An inner wall 23 of the body 16 defines a bore 24 that extends at least partially inwardly to the body 16 from the first end 20. The bore 24 is sized and configured to receive the flag pole 14 in a frictionally-tight fit without the use of adhesive or other securing aids, such as screws, bolts, or other secondary fasteners. Preferably, the device 10 employs a securement rib 13 defined within the bore 24 to secure the flag pole 14 therein.

Figure 6:
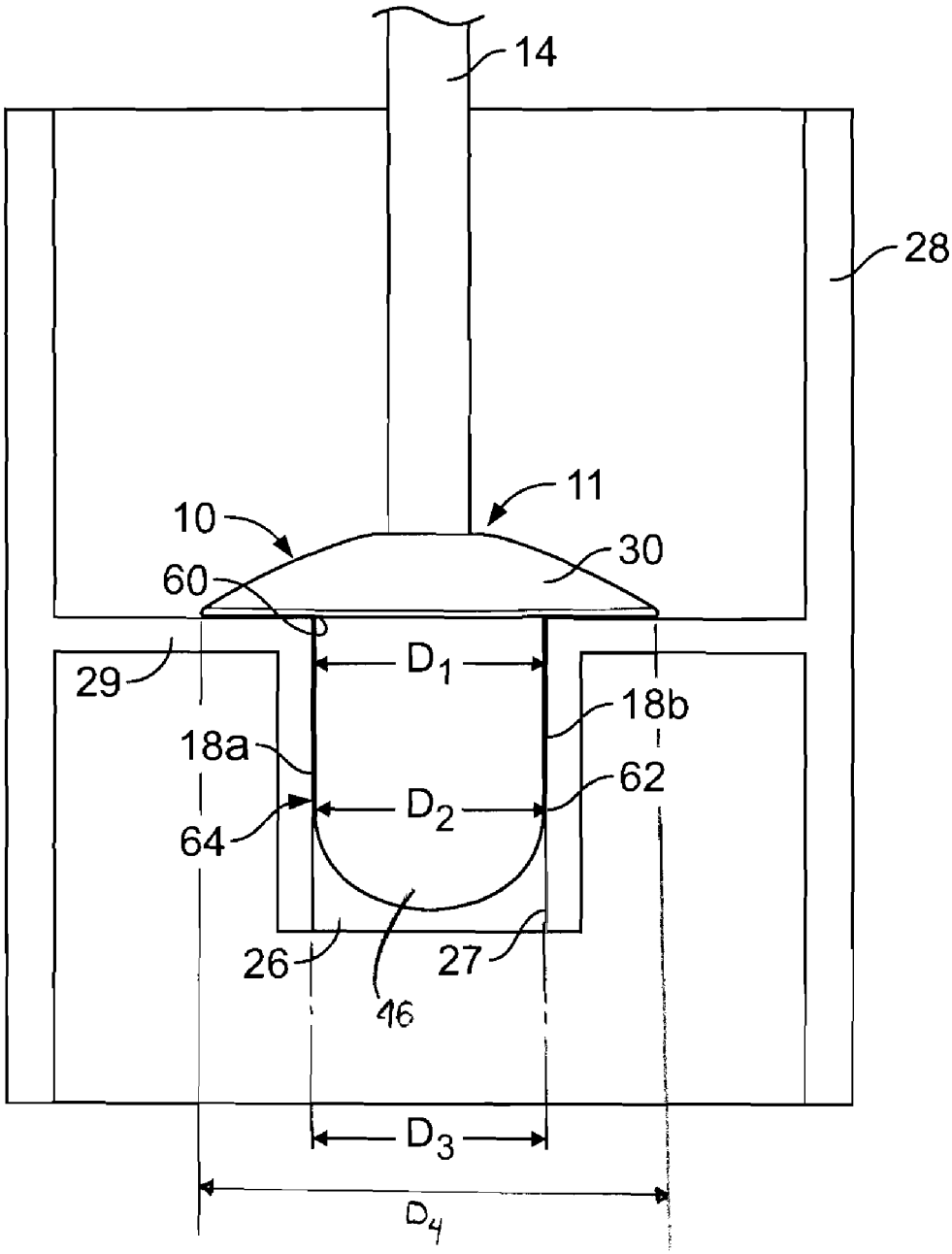
FIG. 6 is a cross-sectional view of the mounting device of FIG. 1 shown coupled to a flag pole end and received in a golf cup.
Figure 7:
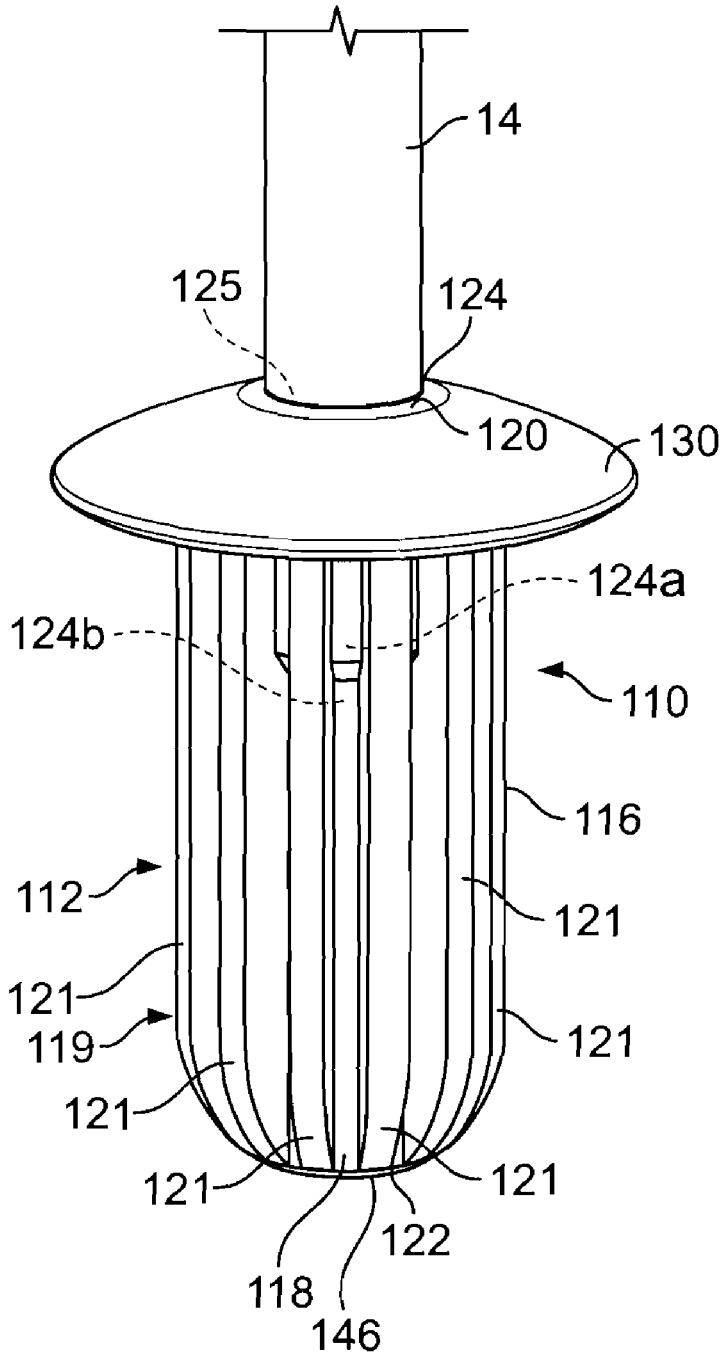
FIG. 7 is a perspective view of a second embodiment of a flag pole mounting device.
Figure 8:
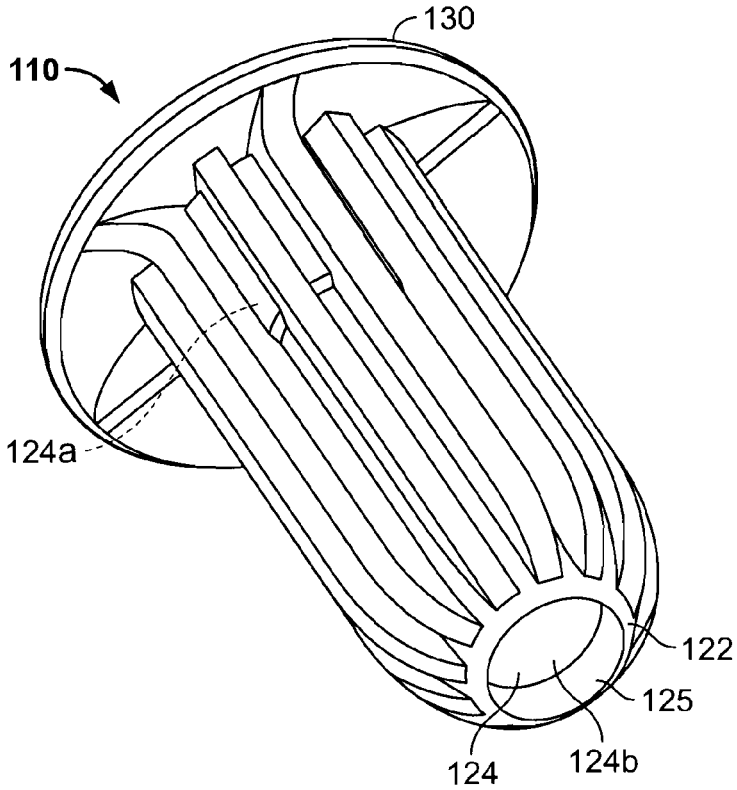
FIG. 8 is another perspective view of the mounting device of FIG. 7.

The mounting device 10 forms an assembly 11 of the flag pole 14 received within the ferrule bore 24 that permits the flag pole 14 to be inserted within a receiving hole 26 of a golf cup 28, as illustrated in FIG. 6. As described further below, the mounting device 10 enhances the stability of the flag pole in the golf cup 28 over traditional, prior art flag poles and permits ease of flag removal without disturbing the embedded golf cup 28. This enhanced stability is even more advantageous in breezy or windy conditions when the mounting device 10 permits the flag pole 14 to remain far more upright and visible to an approaching golfer than traditional flag poles using metal ferrules with tapered sides.

This first embodiment of the mounting device 10 includes a generally smooth surface texture on the side wall 18 in order to provide an increased contact area with the golf cup hole 26. This increased contact area enhances the stability between the device 10 and the golf cup hole 26 because more circumferential engagement between the device 10 and a side wall 27 of the cup hole 26 is achieved to provide stability in more circumferential directions. On the other hand, even with this increased contact area, the mounting device 10 is still easily removed from the cup 28 without disturbing the embedded golf cup due to the material selected to form the device 10. Preferably, the mounting device 10 is formed from a plastic material, such as nylon, or other suitable plastics or polymers. Alternatively, the mounting device 10 can be formed from a ceramic composite material, such as that provided by CerCo (Ohio). Nylon provides a natural lubricity to the mounting device such that a lower coefficient-of-friction between the device side wall 18 and golf cup side wall 27 can be achieved over traditional zinc or zinc alloy ferrules. In this manner, the mounting device 10 formed from the preferred nylon minimizes, and preferably eliminates, sticking between the flag pole and golf cup experienced by many traditional flag poles.

Figure 2:
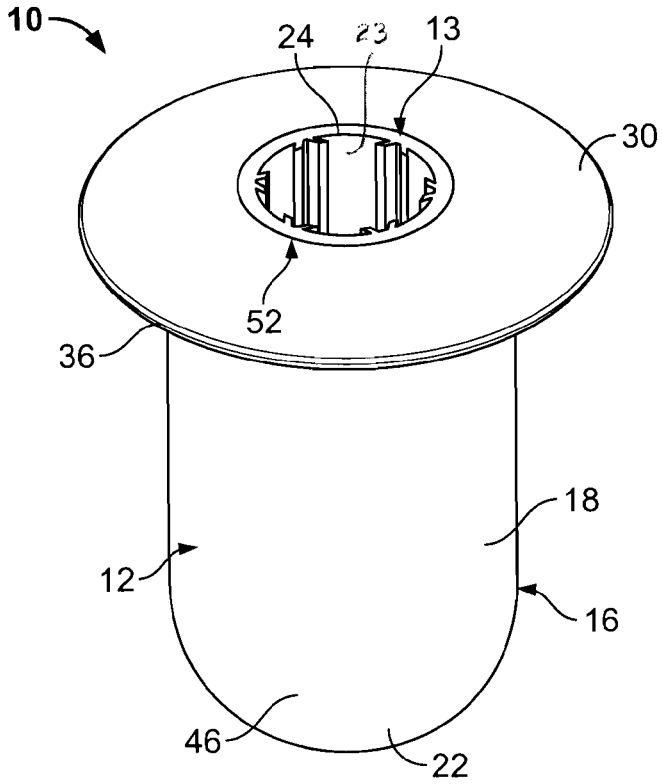
FIG. 2 is a perspective view of the mounting device of FIG. 1.
Figure 3:
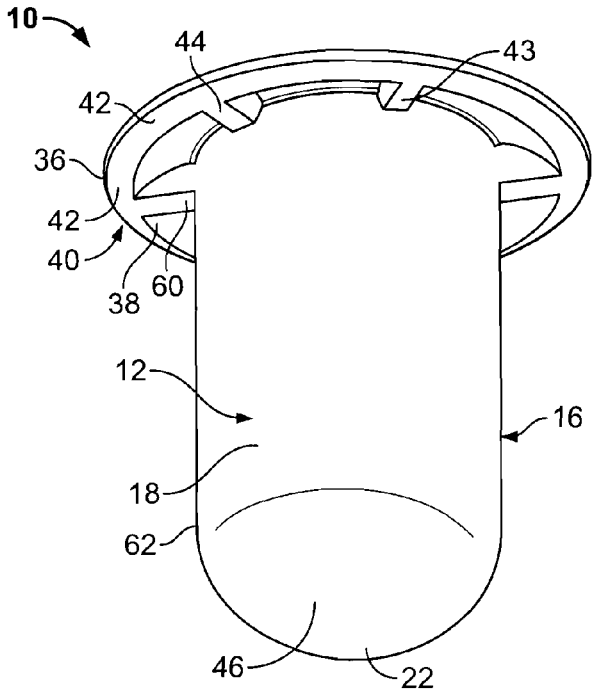
FIG. 3 is another perspective view of the mounting device of FIG. 1.

Referring to FIGS. 1-3, the first end 20 of the cylindrical body 16 preferably includes an annular extension or collar 30 in the form of a cap or cover that extends radially outward beyond the side wall 18 of the body 16. That is, the collar 30 has a diameter D4 that is larger than a diameter D1 of the cylindrical body 16 (FIG. 6). The collar 30 also preferably extends beyond a diameter D3 of the golf cup receiving hole 26 when the device 10 is inserted therein (FIG. 6). Such a configuration advantageously permits the collar 30 to substantially cover or enclose the hole 26. Therefore, when the device 10 is inserted into the hole 26, the collar 30 blocks debris (i.e., sand, dirt, leaves, pebbles, water, moisture, etc.) from falling into the hole 26 by covering an entrance to the hole 26 (i.e., the area between the edge of the ferrule and the hole wall) that is normally open on prior art ferrules. The presence of debris between the device 10 and hole side wall 27 can disadvantageously increase the force needed to remove the flag pole 14. Therefore, the collar 30 also helps to aid in the reduction of sticking force between the device 10 and cup 28 by covering the hole 26 and reducing debris that may fall therein.

As best illustrated in FIG. 1, this embodiment of the collar 30 has an upper surface 32 that is preferably curved or inclined downwardly from an upper edge 34 of the bore 24 towards an outer edge 36 of the collar 30. In this manner, the collar 30 defines an upper profile that facilitates debris that has fallen into the golf cup to easily slide off of the device 10.

The collar 30 may also aid to stabilize the flag pole 14 in the cup. To this end, the collar 30 preferably has a lower surface 38 that extends radially inward towards the side wall 18 from the outer edge 36 as shown in FIG. 3. Preferably, portions of this lower surface 38 extend in a plane generally transverse to the side wall 18 so as to form a stability surface 40. In this embodiment, the stability surface 40 includes a lower circumferential edge 42 of the collar outer edge 36 and a plurality of ribs 43 that extend radially inward from the collar outer edge 36 to the side wall 18. In use, when the device 10 is received within the golf cup hole 26, a lower surface 44 of the ribs 43 and the lower circumferential edge 42 of the collar 30 rest on a lower wall 29 of the golf cup 28 (FIG. 6). In this manner, the stability surface 40 enhances the stability of the flag pole 14 within the golf cup 28 by permitting the flag pole 14 to more firmly rest in the golf cup 28 and stand more upright even in windy or breezy conditions. This enhanced stability results from a larger contact area between the device 10 and the golf cup 28, and in particular, contact of the device 10 and the golf cup lower wall 29 outside of the golf cup hole 26, which is also not found in traditional metal ferrules. While the stability surface 40 is shown generally transverse to the wall 18, it will be appreciated that the stability surface 40 preferably has a profile to confirm to the cup lower wall 29; therefore, if the cup lower wall 29 is curved or inclined, then the surface 40 will also preferably have such a profile.

Again referring to FIG. 3, the second end 22 of the cylindrical body 16 preferably defines a curved profile so as to form a generally domed end 46 of the body 16. In this manner, initial insertion of the mounting device 10 into the golf cup hole 26 can be more easily performed because the domed end 46 does not need close alignment between the device 10 and hole 26. The curvature of the dome 46 guides the mounting device 10 into the golf cup hole 26.

Figure 4:
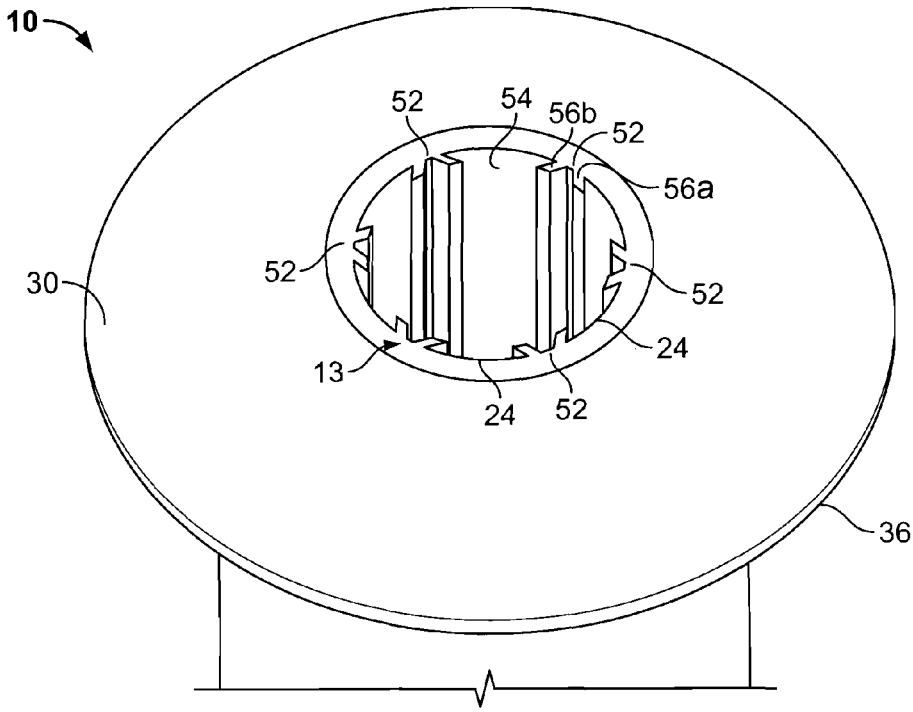
FIG. 4 is yet another perspective view of the mounting device of FIG. 1 showing a central bore and the first embodiment of an attachment device defined in the central bore.
Figure 5A:
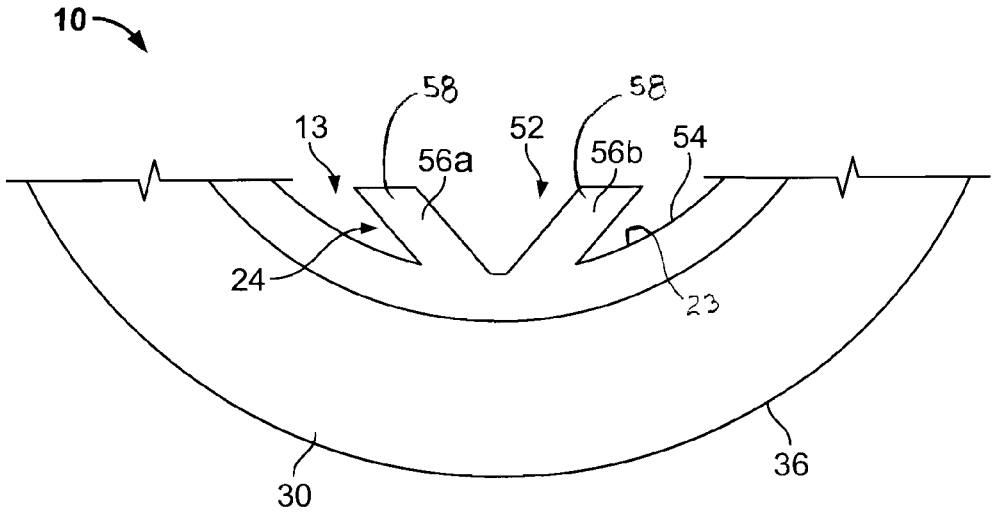
FIGS. 5A and 5B are partial, plan views showing alternative configurations of the attachment device of FIG. 4.
Figure 5B:
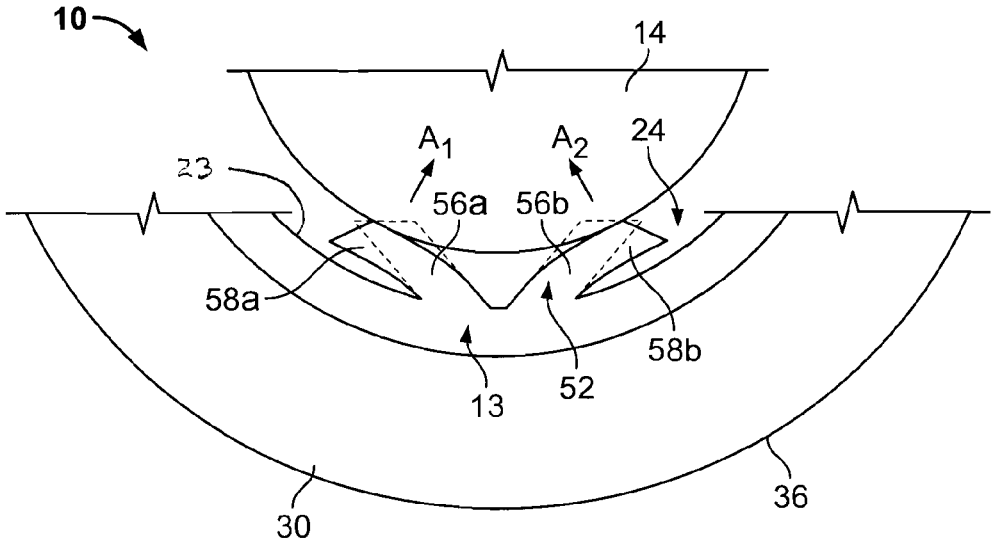

One example of the securement rib 13 within the bore 24 is illustrated in FIGS. 4, 5A, and 5B. As discussed previously, the securement rib 13 permits attachment of the mounting device 10 to the flag pole through a friction-tight fit without the use of adhesives or other secondary fasteners, such as screws, bolts, pins, and the like. In one form, the securement rib 13 includes a plurality of inwardly-directed rib members 52 that are circumferentially spaced about an inner wall 23 of the bore 24 and preferably, though not necessarily, extend substantially the entire axial length of the bore 24.

Each rib member 52 preferably includes a pair of facing fins 56*a* and 56*b* that extend radially inward to the bore 24 from the bore inner wall 23, as illustrated in FIG. 5A. In this embodiment, the fins 56*a* and 56*b* taper away from each other as they extend radially into the bore 24 so as to form a generally V-shape with an angle between the fins 56*a* and 56*b* between about 40 and about 50 degrees. The securement rib 13 is illustrated with six spaced rib members 52; however, varying numbers of rib members and different angles between the fins may also be employed in the device 10. For example, the fins 56*a* and 56*b* may be generally parallel rather than tapered.

One example of how the rib members 52 permit a tight, friction fit between an end of the flag pole 14 and the bore 24 is illustrated in FIG. 5B. For example, this tight, friction fit with a flag pole is achieved by deforming a deformable portion 58 of each rib member 52. In this embodiment, the deformable portion 58 includes a portion 58*a* and 58*b* of each fin 56*a* and 56*b*, respectively, that deforms by bending, deflecting, or compressing inwardly towards the bore inner wall 23 when it interacts with a received flag pole 14. The portions 58*a* and 58*b* deform because the radial length of the ribs 52 provide a space within bore 24 that is slightly smaller than the diameter of the pole 14. Therefore, the portions 58*a* and 58*b* preferably deform in order for the pole 14 to be received within the bore 24.

The deforming of portions 58*a* and 58*b* also preferably provide opposing forces A1 and A2 that are generally directed inwardly to the bore 24 as the fins 56*a* and 56*b* attempt to resiliently move back towards their original configuration. In this manner, the spaced deformable portions 58 surrounding the flag pole 14 and the resultant forces A1 and A2 from each deformable portion 58 securely hold the pole 14 within the bore 24 without adhesive or other fasteners. While the description above corresponding to FIGS. 5A and 5B illustrates a preferred securement rib 13, this description is only exemplary and not intended to limit how the pole 14 is secured within the bore 24.

Turning to FIG. 6, the cylindrical body 16 of the mounting device preferably has a substantially consistent diameter along at least a portion of an axial length thereof. In other words, a diameter D1 of the cylindrical body adjacent a transition 60 between the cover lower surface 38 and the body side wall 18 is substantially the same as a diameter D2 of the cylindrical body 16 adjacent a transition 62 between the side wall 18 and the start of the doomed end 46. In this manner, the side wall 18 of the body 16 preferably forms a generally right circular cylinder along at least a portion thereof where a cross-section of the body 16 at the transition 60 is substantially the same as the cross-section of the body at the transition 62. However, a slight draft angle may be present if the cylindrical body is made using injection molding techniques.

With such configuration of the body 16, opposite side portions 18*a* and 18*b* of the side wall 18 are generally parallel with each other rather than the generally tapered side walls of prior art ferrules. As shown in FIG. 6, the parallel side wall portions 18*a* and 18*b* provides for a substantially consistent relationship 64 between the side wall 18 and the golf cup hole wall 27 along at least a portion of the body 16 because the diameters D1 and D2 are generally close to the diameter D3 of the cup hole 26. This substantially consistent relationship 64 provides a more stable coupling between the device 10 and the golf cup hole 26 due to more contact area between the device 10 and the cup walls 27. As discussed above, even with this close relationship between the device 10 and cup hole 26, the natural lubricity of the preferred nylon used to construct the device 10 allows ease of separation with minimal, and preferably no, sticking of the device 10 to the cup 28.

Referring to FIGS. 7-10, there is illustrated a second embodiment of a mounting device 110 in the form of a modified ferrule 112. Device 110 is similar to the previously described mounting device 10 and includes a body 116 having a side wall 118, a first end 120, and a second end 122. The body 116 also includes a collar 130 and an inner wall 123 that forms a bore 124 similar to the previous embodiment. The description below of the device 110 focuses on the differences from the previously describe device 10, which includes a modified securing device 113 and the use of a profiled side wall 116.

In this embodiment, the side wall 118 includes a contoured profile 119 that minimizes the surface area of the side wall 118 that is adjacent to the cup inner wall 27 through a plurality of ribs 121 that extend radially outward from the side wall 118. Preferably, the ribs 121 extend the entire axial length of the cylindrically body 116 and also curve inwardly at the end 122 to form part of a domed end 146. The body 116 includes a number of ribs surrounding the device 10 to provide sufficient contact with the golf cup hole 26 to facilitate a stable coupling, but also provide less surface area on the outer surface of the body 116 to achieve a lower coefficient-of-friction between the device 110 and the cup hole 127. Preferably twelve ribs 121 are formed on the cylindrical body; however, more or less ribs may be provided as needed. In addition, while the ribs 121 are illustrated along the entire axial length of the body 116, it will be appreciated that the ribs 121 may also extend any length along the side wall 116.

Figure 9:
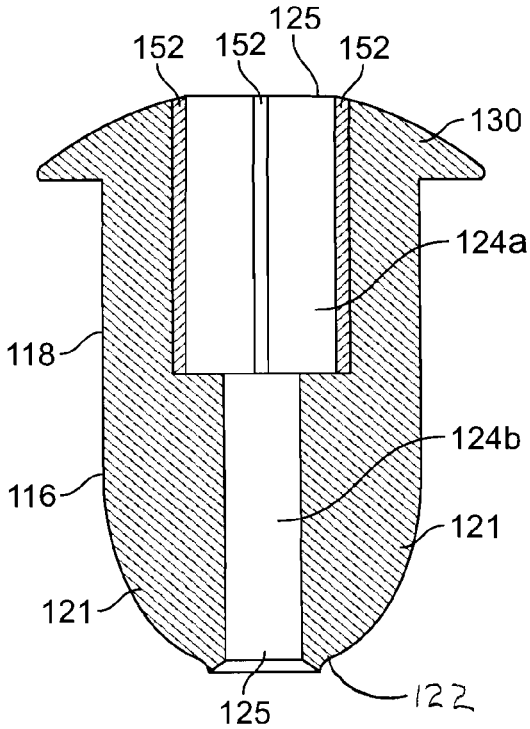
FIG. 9 is a cross-sectional view of the mounting device of FIG. 7.

In this embodiment, the bore 124 preferably extends throughout the entire body 116 such that an opening 125 is formed on both ends 120 and 122 of the body 116 as exemplified in FIG. 9. If desired, a diameter of the bore may vary as it extends throughout the body 116. For instance, the bore 124 may have a first portion 124*a* sized to receive the flag pole 14 therein and a second, narrower portion 124*b* extending through the remainder of the body 116. The opening 125 on the second end 122 is advantageous because it can trap any debris in the golf cup hole 26 therein rather than such debris being trapped between the ferrule 112 and cup hole side wall 27.

Figure 10A:
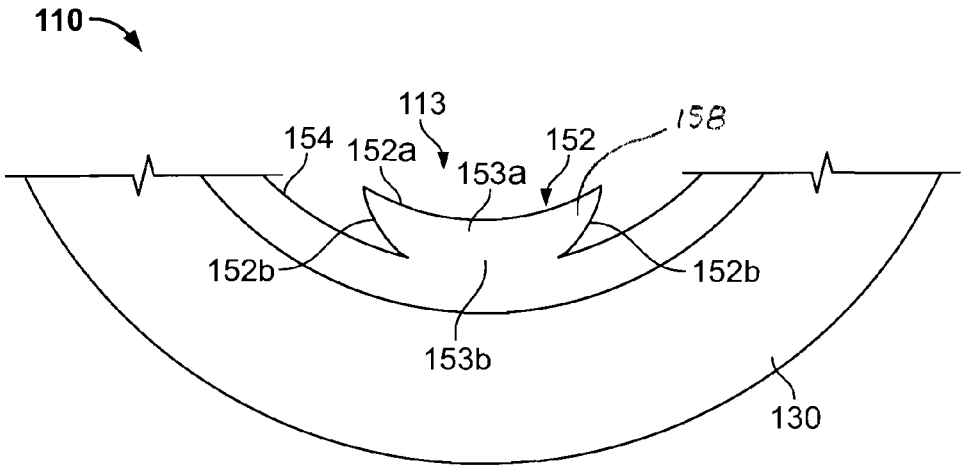
FIGS. 10A and 10B are plan views showing alternative configurations of the second embodiment of an attachment device.
Figure 10B:
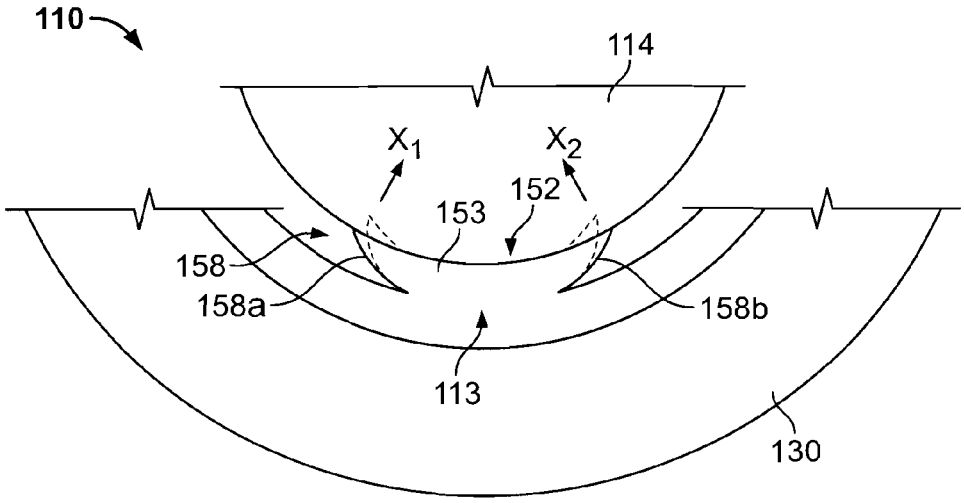

Referring to FIGS. 10A and 10B, a second embodiment of a securement rib 113 is illustrated. Similar to the previous securement rib 13, the member 113 permits the ferrule 112 to securely hold the flag pole 14 through a friction-type fit and preferably eliminates the need for adhesive or secondary fasteners to hold the flag pole 14 within the ferrule 112.

In this embodiment, the attachment member 113 also includes a plurality of ribs 152 spaced circumferentially about an inner wall 154 of the bore 124. In this form, the ribs 152 preferably are a unitary structure defined by an arcuate outer wall 152*a* and inwardly tapered side walls 152*b*. The ribs 152 include a larger portion 153*a* spaced radially inward from the bore inner wall 123 and a narrower portion 153*b* radially adjacent the bore inner wall 123.

To securely couple the pole 14 to the device 110, the ribs 152 also preferably include deformable portions 158 that deform by bending, deflecting, or compressing inwardly toward the bore inner wall 123 when a flag pole is inserted into the bore 124. In this embodiment, the deformable portions 158 include opposite spaced ends 158*a* and 158*b* of the rib larger portion 153*a*. Preferably, the deformable portions 158*a* and 158*b* resiliently deform inwardly to permit the arcuate inner wall 152*a* to better conform to the curvature of the flag pole 14. In this manner, the deformation of the end portions 158*a* and 158*b* provides an opposite force X1 and X2 directed inwardly to the bore 124 as the end portions 158*a* and 158*b* attempt to resiliently move back towards their original configuration. The inward deformation and resultant forces of the end portions 158*a* and 158*b* of the spaced ribs 152 surrounding the flag pole 14 securely holds the pole 14 within the bore 124 without adhesive or other fasteners. While the description above corresponding to FIGS. 10A and 10B illustrates a preferred securement rib 113, this description is only exemplary and not intended to limit how the pole 14 is secured within the bore 124. The friction-type fit of the securement rib 113 may also be achieved through other mechanisms.

It will be understood that various changes in the details, materials, and arrangements of parts and components which have been herein described and illustrated in order to explain the nature of the device may be made by those skilled in the art within the principle and scope of the device as expressed in the appended claims. For example, adhesive or other such fasteners may be used in addition to the above devices.

What is claimed is:

1. A device for mounting a flag pole in a golf cup hole, the device comprising:

a body having a side wall and first and second ends;

an inner wall of the body defining a bore extending at least partially into the body from the first end, the bore sized to receive an end of a flag pole without adhesive;

a plurality of ribs on the bore inner wall that extend radially into the bore, the ribs having a radial length providing a frictionally-tight fit between the body and a received flag pole; and wherein each rib comprises a pair of fins.

2. The device of claim 1, further comprising a deformable portion on each rib positioned to deform upon a flag pole end received in the bore to provide the frictionally-tight fit between the body and a flag pole.

3. The device of claim 2, wherein each fin tapers away from the other and at least a distal portion of each fin is the deformable portion.

4. The device of claim 3, wherein the device is made of nylon.

5. The device of claim 1, wherein the rib comprises a wider portion radially spaced from the bore inner wall and a narrower portion adjacent the bore inner wall.

6. The device of claim 5, further comprising a deformable portion of each rib positioned to deform upon a flag pole end received in the bore to provide the frictionally-tight fit between the body and a flag pole.

7. The device of claim 6, wherein opposite end portions of the wider portion are the deformable portion.

8. The device of claim 7, wherein the device is made of nylon.

9. The device of claim 1, wherein the body has an outer diameter substantially constant along at least a portion of an axial length of the side wall such that a mounted device forms a substantially consistent relationship between the side wall portion and an inner surface of a golf cup hole when the flag pole is mounted therein.

10. The device of claim 9, wherein the side wall curves inwardly at the second end of the body to permit ease of initial insertion of the device into a golf cup hole.

11. The device of claim 1, further comprising a collar at the first end of the body, the collar extending radially outward beyond the body side wall.

12. The device of claim 11, wherein the collar defines an inclined upper surface extending downwardly from the bore to an outer edge of the collar to facilitate debris in sliding off the cover.

* * * * *